US008590596B2

(12) United States Patent
Shaber

(10) Patent No.: US 8,590,596 B2
(45) Date of Patent: Nov. 26, 2013

(54) COOLANT CONTROL AND WIPER SYSTEM FOR A CONTINUOUS CASTING MOLTEN METAL MOLD

(75) Inventor: Craig Shaber, Spokane Valley, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 12/931,257

(22) Filed: Jan. 25, 2011

(65) Prior Publication Data

US 2012/0186773 A1 Jul. 26, 2012

(51) Int. Cl.
*B22D 11/124* (2006.01)
*B22D 11/16* (2006.01)

(52) U.S. Cl.
USPC ..... 164/487; 164/444

(58) Field of Classification Search
USPC ..... 164/487, 444
See application file for complete search history.

(56) References Cited

U.S. PATENT DOCUMENTS

| | | | | |
|---|---|---|---|---|
| 2,705,353 | A | 4/1952 | Zeigler | |
| 4,237,961 | A | 12/1980 | Zinniger | |
| 5,255,731 | A * | 10/1993 | Yun | 164/135 |
| 7,871,478 | B2 | 1/2011 | Wagstaff et al. | |
| 2007/0102136 | A1 * | 5/2007 | Wagstaff et al. | 164/487 |

FOREIGN PATENT DOCUMENTS

GB 2077643 A 12/1981

* cited by examiner

*Primary Examiner* — Kevin P Kerns
(74) *Attorney, Agent, or Firm* — Wells St. John, PS

(57) ABSTRACT

A coolant or wiper control system for use in continuous casting mold for controlling and managing the coolants interaction with the castpart during casting. In some aspects of the process, the wiper framework is started sufficiently away from the bottom block so as not to interfere or cause/allow coolant to get into the bottom block; is then rapidly moved back to the emerging castpart during transient heat-up; and then moved away from the mold with the solidified castpart at a controlled rate to a predetermined steady state position or to a second transitory state of the casting.

6 Claims, 10 Drawing Sheets

| WIPER MOTION | | SUMP DEPTH | |
|---|---|---|---|
| Length (mm) | mm | Length (mm) | mm |
| 0 | 350 | 0 | 175 |
| 300 | 350 | 300 | 325 |
| 350 | 150 | 350 | 350 |
| 750 | 450 | 750 | 380 |

FIG. 9

COOLANT CONTROL AND WIPER SYSTEM FOR A CONTINUOUS CASTING MOLTEN METAL MOLD

CROSS REFERENCE TO RELATED APPLICATION

This application does not claim priority from any other application.

TECHNICAL FIELD

This invention pertains to coolant control and wiper system for use in a continuous casting molten metal mold, which may include positional wiper management and a retractable feature for better system control.

BACKGROUND OF THE INVENTION

Metal ingots, billets and other castparts may be formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation, aluminum, brass, lead, zinc, magnesium, copper, steel, etc., the examples given and preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a bottom block 108 (also referred to as a starting head or starting block base), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart 113 (which may be an ingot or a billet) being partially formed. Castpart 113 is on the starting block base 108, which may include a starting head or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block is typically used when an ingot is being cast and starting head, when a billet is being cast.

While the starting block base 108 in FIG. 1 only shows one starting block 108 and pedestal, there are typically several of each mounted on each starting block base, which simultaneously cast billets, special tapers or configurations, or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a pre-determined rate, thereby lowering the ram 106 and consequently the starting block at a pre-determined and controlled rate. The mold is controllably cooled during the process to assist in the solidification of the emerging ingots or billets, typically using water cooling means. Although the use of a hydraulic cylinder is referred to herein, it will be appreciated by those of ordinary skill in the art that there are other mechanisms and ways which may be utilized to lower the platen.

There are numerous mold and casting technologies that fit into mold tables, and no one in particular is required to practice the various embodiments of this invention, since they are known by those of ordinary skill in the art.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired profile, taper or other desired configuration. In some casting technologies, there may be an air gap between the emerging solidified metal and the permeable ring wall, while in others there may be direct contact. Below that, there is also a mold air cavity between the emerging solidified metal and the lower portion of the mold and related equipment.

Once casting is complete, the castparts, billets in this example, are removed from the bottom block.

The casting process is initiated by the introduction of molten metal into the mold cavity and the solidification of the molten metal through the mold cavity occurs by the application of a cooling fluid such as water. The cooling fluid is applied around the perimeter of the mold cavity and in the process, causes the walls of the mold cavity to cool. As the mold cavity wall is cooled the molten metal adjacent the wall generally solidifies and shrinkage occurs around the solidifying surface of the castpart. The shrinkage of the castpart then causes the solidifying castpart to shrink back away from the cooler mold wall, resulting in some re-melting of solidifying surface of the castpart and expansion back to the mold wall. This solidification process occurs and the resulting castpart emerges out of the mold cavity with a solidified outer surface or skin and the inner core of the castpart is still in its molten state. A continuous supply of cooling fluid is applied to the perimeter of the solidifying castpart emerging from the mold cavity.

The volume of cooling fluid supplied to the emerging castpart can be significant and if left uncontrolled, it will run down the side of the outer surface of the castpart and cause further cooling and solidification of the core of the castpart. The exposure of the outer surface of the castpart to the dripping or flowing cooling fluid after the initial direct chill of the emerging castpart alters the cooling characteristics of the castpart and the metallurgical characteristics of the resulting castpart. The process of continuous casting in general results in a relatively fast solidification of the exterior of the castpart (especially for larger castparts such as ingots) but the interior still remains in some status between molten and solidified. This results in internal stresses being imposed between the various internal locations in the castpart and may result in undesirable imperfections and defects.

It is desirable to control the flow and cooling effect of the cooling fluid after its initial direct chill of the castpart. The direct chill of the cooling fluid solidifying the outer surface or skin of the castpart causes internal stresses in the metallic structure; however if the temperature of the core of the solidifying castpart is allowed to remain high for a period after the initial direct chilling, an annealing occurs within the castpart relieving shrinkage stress. This is especially true of some of the more desired alloyed materials such as those used in the aerospace industry, such as series 2XXX and/or 7XXX alloys.

If the excess cooling fluid is not sufficiently controlled and runs down the side of the cooling castpart, it causes unwanted additional cooling of the core of the castpart and impedes the desired annealing process in the castpart.

Wiper type systems have been long used in the industry to control the flow of excess cooling fluid on the surface of the cooling castpart. These prior wiper systems were developed to control and/or divert the coolant away from the lower portions of the solidifying castpart. A wiper generally conforms to the outer surface of the castpart and is in contact around that outer surface. A wiper is similar in some ways to a squeegee used on a window and is mounted relative to the castpart such that the coolant is diverted away from and off the surface of the castpart.

It has been common in the industry to use wipers made of silicone, inflatable rubber-type wipers, or what is commonly referred to as air knives, to accomplish the wiping or diversion of the undesired excess cooling fluid. A wiper is generally configured annularly around the particular castpart and is designed to be in contact with the outer surface of the castpart. The wiper generally diverts the cooling fluid away from the outer surface of the castpart so that it descends into the casting pit away from the surface of the castpart to avoid an undesirable cooling effect.

The traditional use of a wiper system has been to have a fixed or static location of the wiper far enough below the mold to prevent overheating in a steady state or second transitory stage, and close enough to the mold so that the castpart could retain sufficient heat to cause an annealing effect on the castpart. At or near the start up of these traditional systems, the solidifying castpart would pass through the wipers but there is a time when extra water would become trapped between a wiper, starting block or head and the castpart for a period of time (normally minutes). This additional water at startup results in increased and undesirable cooling of the castpart and may also allow cooling fluid to get into the starting block area and increase the probability of a crack forming at or near the butt portion of the castpart during or after solidification. In some embodiments of this invention, the wiper is moved sufficiently below the casting mold and castpart starting block to avoid mis-directing coolant to the starting block or elsewhere during the startup phase or stage.

It is therefore an object of some embodiments of this invention to provide a new wiper actuator and a new process to better position the coolant control system, or wiper, relative to the cast length. This object is to optimize the timing and positions of the coolant or wiper control system relative to the mold to result in a better annealing of the castpart while minimizing capture or trapping of undesirable coolant in the starting block or starting head.

The bottom or base of the solidified castpart may be referred to as the butt and the butt of the castpart is an area where a high incidence of cracks and other undesirable potential castpart defects occur. If cracks develop in the butt portion of the castpart, the castpart is generally scrapped, the molten metal must be remelted and purified all over again. It is costly to have to scrap an entire casting due to a crack in the butt portion of the ingot or castpart.

This invention provides a cooling fluid or wiper control system which more effectively uses, places and moves the wiper during stages of the casting process to provide a better controlled cooling of the solidified castpart. The prior art placement of a wiper in one position relative to the castpart during the entire cast does not as effectively optimize the cooling of the castpart as compared to this invention. It is important that the castpart cooling be controlled and optimized during startup, the transient heat-up stage and then during steady state.

It is therefore an objective of some embodiments of this invention to provide a cooling fluid and wiper control system which more effectively controls the wiper position and movement during all three stages of casting, namely during startup, the transient heat-up stage and the second transitory stage.

In some embodiments of this invention this objective may be met by starting the wiper away from the solidifying metal and cooling fluid during startup, rapidly moving the wiper to the solidifying castpart during the transient heat-up stage, and then controlling the movement and location of the wiper in a direction away from the mold during the second transitory stage of casting.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF THE DRAWINGS

Preferred embodiments of the invention are described below with reference to the following accompanying drawings.

FIG. 9 is a table illustrating exemplary positions of the wiper motion versus the sump depth.

DETAILED DESCRIPTION OF THE PREFERRED EMBODIMENTS

Figure 1:
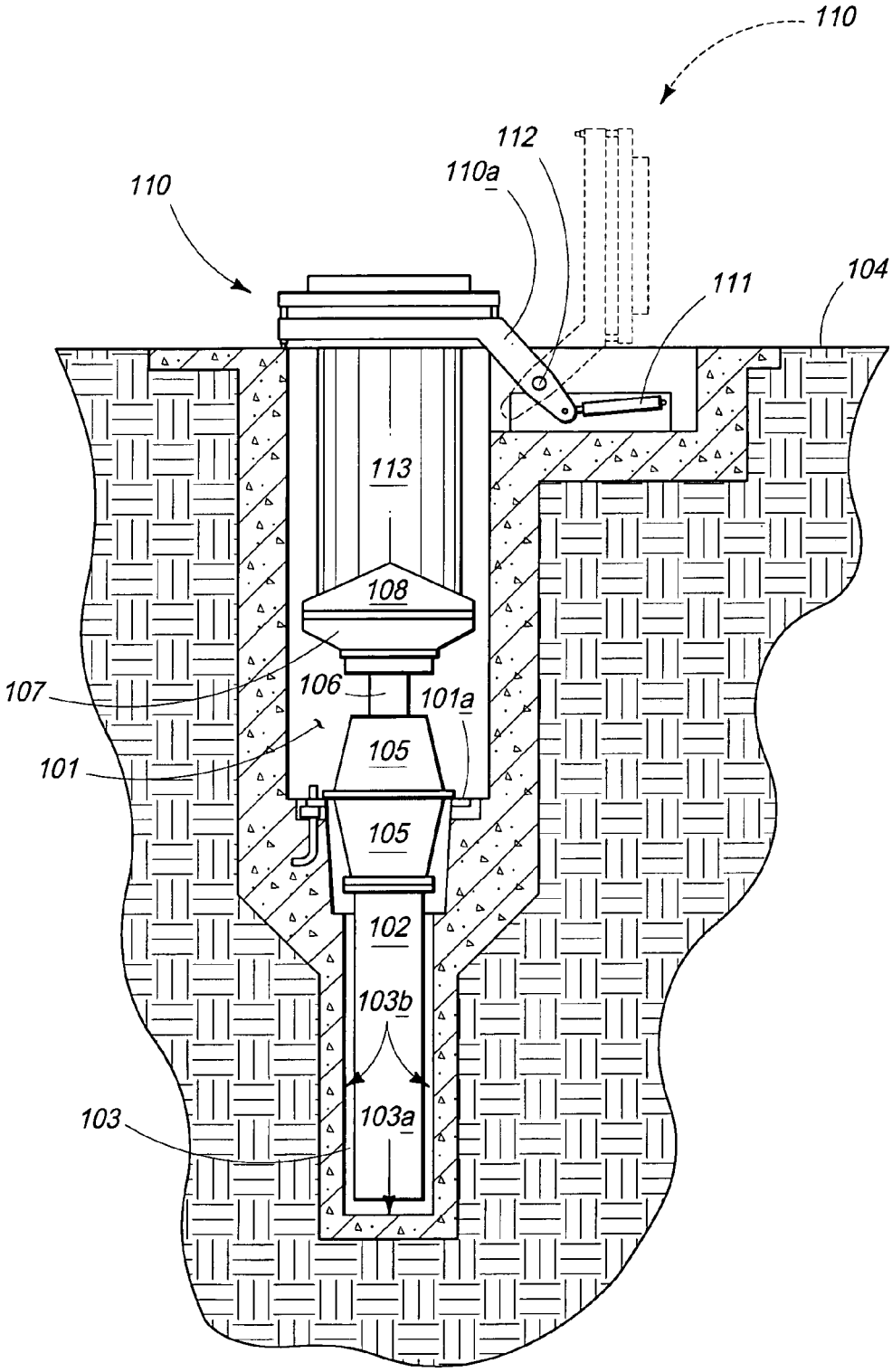
PRIOR ART FIG. 1
FIG. 1 is an elevation view of a prior art vertical casting pit, caisson and metal casting apparatus.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention can be utilized in connection with various types of metal pour technologies and configurations. It is further to be understood that this invention may be used on horizontal or vertical casting devices.

A mold or mold framework which may be utilized in embodiments of this invention therefore must be able to receive molten metal from a source of molten metal, whatever the particular source type is. The mold cavities in the mold must therefore be oriented in fluid or mold metal receiving position relative to the source of molten metal.

It will also be appreciated by those of ordinary skill in the art that embodiments of this coolant control system and wiper system, may and will be combined with existing systems and/or retrofit to existing operating casting systems, all within the scope of this invention.

In some embodiments of this invention, the process or control system may present opportunities for the casting process at three stages: (1) at startup, the wiper may be placed just below the starting head and castpart to prevent the trapping of excess or undesirable cooling fluid (normally water) under the butt of the castpart during the startup of casting. This will be referred to as the startup or non-interference stage or phase. (2) During the next stage of casting, the transient heat up stage, the coolant control or wiper system may be moved toward the mold cavity past the butt portion of the castpart in a rapid manner so that water is not trapped between the wiper, the castpart butt and the starting head or bottom block. This rapid movement toward the mold cavity may be referred to as upward, but it will be appreciated by those in the art that this system is not so limited to substantially vertical systems. Coolant control or wiper systems contemplated by this invention may progress or be moved above the liquid sump and curl notch, which allows it to cleanly wipe water off the faces of the castpart early in the process.

There are opportunities for achieving the objectives and coolant control at a third stage, which may also be referred to as the steady-state or annealing stage. In this stage, the coolant control system or wiper system is slowly moved along the solidified castpart and in a direction away from the mold cavity (which would be vertically downward in a vertical continuous casting arrangement). The coolant control system may be lowered to any desired steady-state position depending on the casting. One example of such movement is to position the wiper below the sump to prevent overheating of the castpart while the castpart is in steady-state movement. This type of control allows desirable annealing of stresses within the castpart as a result of the wiping diversion of the liquid coolant off the exterior surface of the castpart.

FIG. 1 is described above in the Background of the Invention section, and will not therefore be repeated here.

Figure 2:
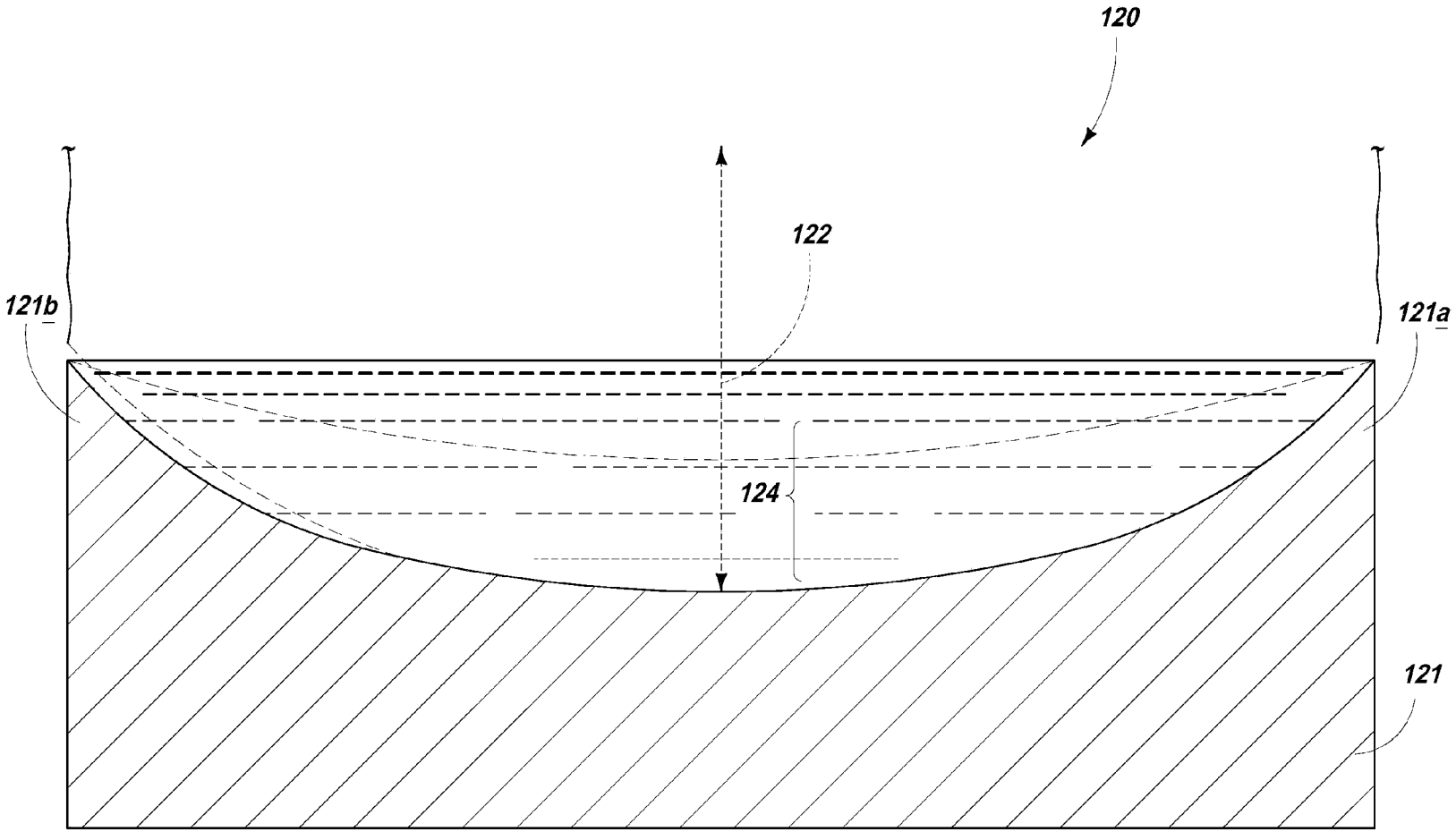
FIG. 2 is an elevation cross-section view of a typical bottom block configuration.

FIG. 2 is an elevation cross-section view of a typical bottom block configuration 120, and illustrates bottom block 121 with bottom block sides 121*a* and 121*b*, and showing the height 122 of the butt portion of the castpart. Zone 124 in the bottom portion of the castpart is vulnerable to cracking and other quality issues if the cooling and application of coolant is not sufficiently controlled, especially in the aerospace type alloys such as 2XXX and 7XXX.

Figure 3:
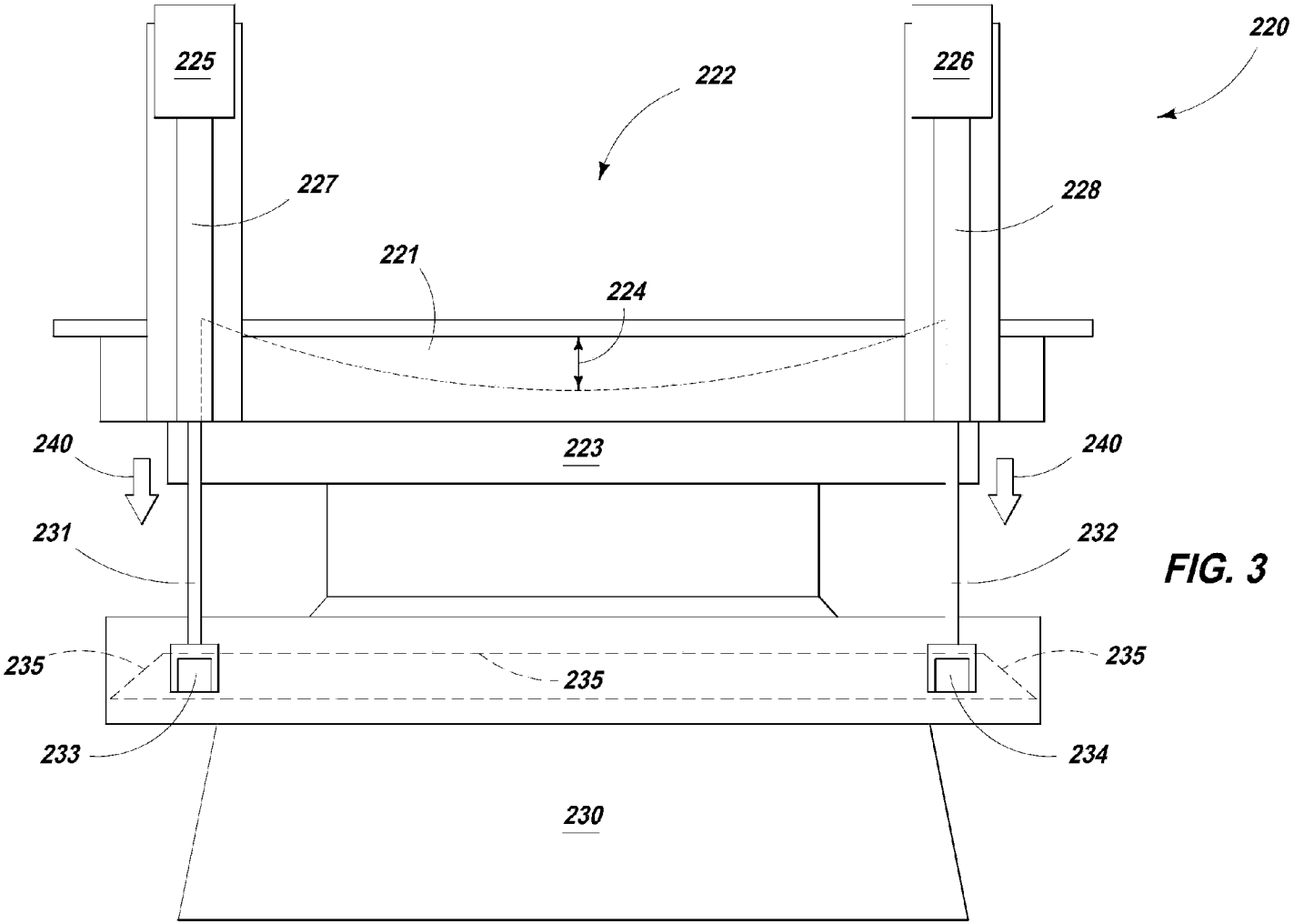
FIG. 3 is an elevation view of a continuous cast mold at or near the start of casting, with the bottom block positioned at the bottom of the mold cavity, and the coolant control system in a lowered position below the bottom block.

FIG. 3 is an elevation view of a continuous cast mold 222 near the start of casting in one embodiment of this invention, with the bottom block 223 positioned up at the bottom of the mold cavity, and the coolant control system 220 in an extended position below the bottom block. FIG. 3 illustrates mold framework 221, gap 224 between bottom block 223 and the mold cavity before the introduction of molten metal. FIG. 3 also illustrates wiper system with actuators 225 and 226 on support structures 227 and 228, rams 231 and 232 extending therefrom and being operatively attached through wiper mounts 233 and 234 to the castpart wiper 235. As is known in the art, the size and shape of the wiper would be configured to conform to the cross sectional shape of the castpart in this embodiment. Arrows 240 indicate that the bottom block will be moving downwardly once casting begins and platen 230 is shown below and supporting the bottom block 223. FIG. 3 also illustrates the positioning of the wipers or wiper blade, out of the way at the initial startup to avoid allowing or causing undesirable coolant from being provided to the bottom block 223. In some embodiments of the invention at the transition heat-up, the castpart wiper may be moved up to a position at or near the bottom of the mold, which in some embodiments of this invention may be above the starting head lip and butt curl notch.

Figure 4:
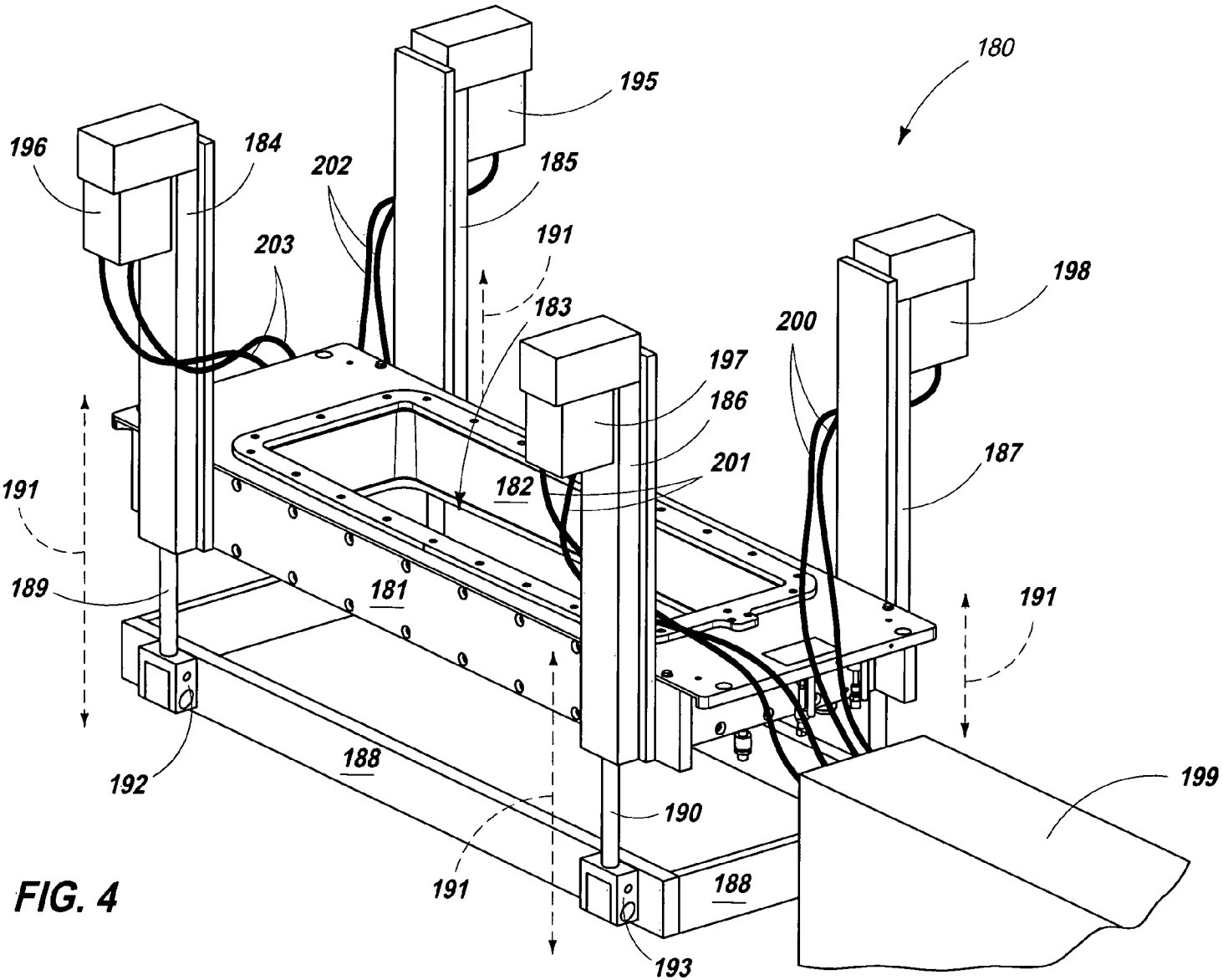
FIG. 4 is a perspective view of an embodiment of this invention mounted relative to a continuous casting mold framework, wherein the coolant control system is comprised of a wiper and is shown in a startup position which is below the bottom block.

FIG. 4 is a perspective view of an embodiment of this invention mounted relative to a continuous casting mold framework 181, wherein the coolant control system 180 is shown in one possible configuration that may be desired at startup. In FIG. 4, the wiper is shown lowered out of the way of the starting block or bottom block (not shown in this figure), which may be a preferred location during startup to help prevent additional cooling fluid getting in the starting block. If the wiper is located right at or near the starting block and mold cavity during startup, it may increase cooling fluid in the starting block area and increases the probability of a crack forming at or near the butt portion of the castpart during or after solidification.

Arrows 191 show how the hydraulic rams 189 and 190 (others not shown) can be extended and retracted to move the wiper control system 180. Having the hydraulic rams 189 and 190 extended in this way (away from the mold) provides for a more desirable startup condition as stated above. FIG. 4 illustrates wiper framework 188, wiper mounts 192, 193 and 194 which mount the wiper framework to the rams 189 and 190.

FIG. 4 also illustrates one way to practice the control aspect of this invention with actuators 195, 196, 197 and 198 being electrically connected to controller 199 via electrical conduits or wires 200, 201, 202, and 203. FIG. 4 also shows mold cavity wall 182, mold cavity 183, wiper drive frameworks 184, 185, 186 and 187, each operatively mounted to or with respect to mold framework 181. It will be appreciated by those of ordinary skill in the art that any one of a number of controllers and actuators may be utilized in practicing this invention, with no one in particular being required to practice all embodiments of this invention.

Figure 5:
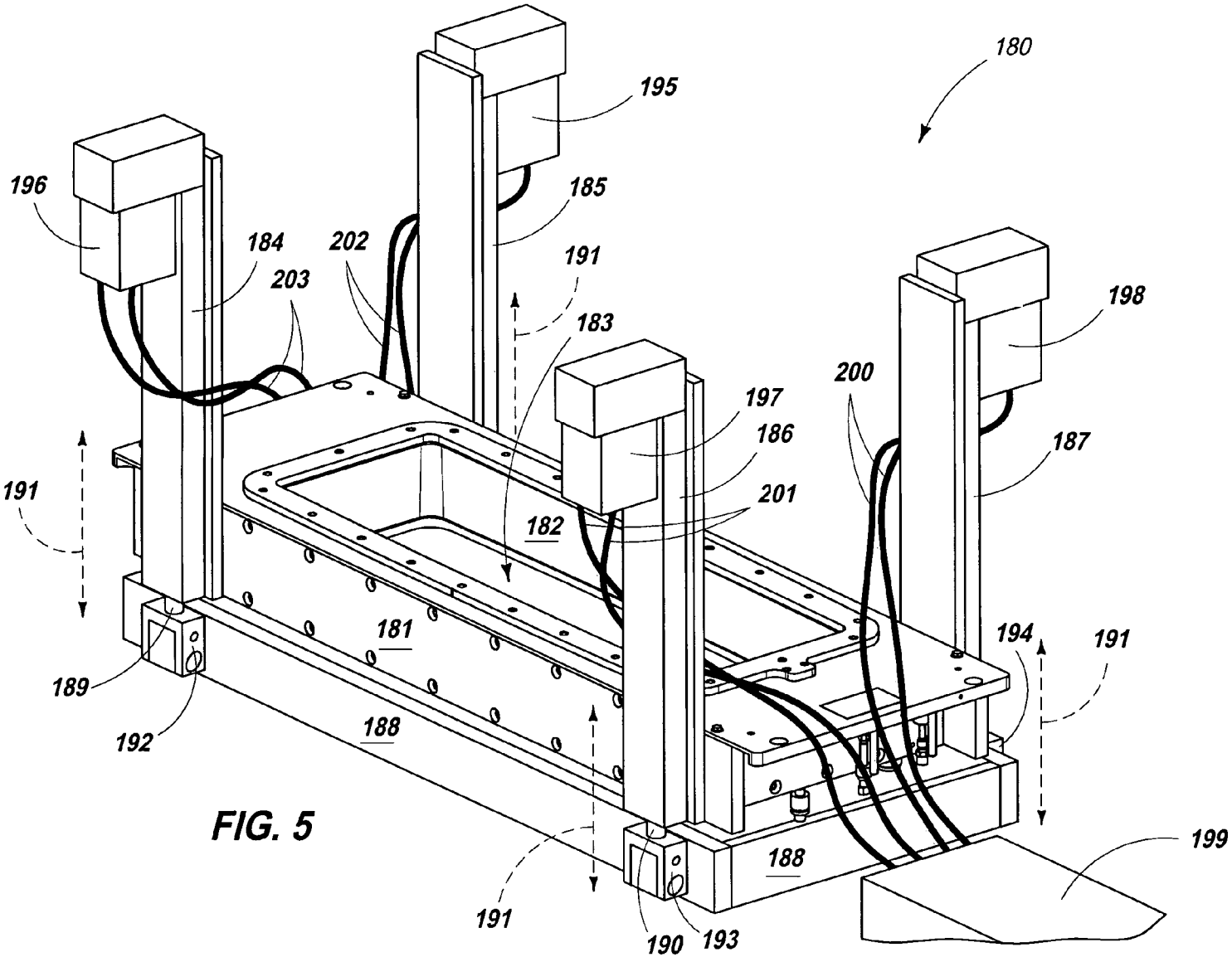
FIG. 5 is a perspective view of an embodiment of this invention mounted relative to a continuous casting mold framework, wherein the coolant control or wiper system is shown in a position right after startup and after it has been retracted back toward the mold cavity.

FIG. 5 is a perspective view of an embodiment of this invention mounted relative to a continuous casting mold framework, wherein the coolant control or wiper system 180 is shown in a position right after startup and after it has been moved back toward the mold 181. Like numbered items from FIG. 4 will not be repeated here. This phase of casting may be referred to as the transient heat-up stage. After being started away from the bottom block during startup, it is preferable in some embodiments of this invention to rapidly move the castpart wiper framework 188 to a position at or near the mold cavity 183 exit. This will reduce the undesirable cooling of the castpart during the transient heat-up stage.

Figure 6:
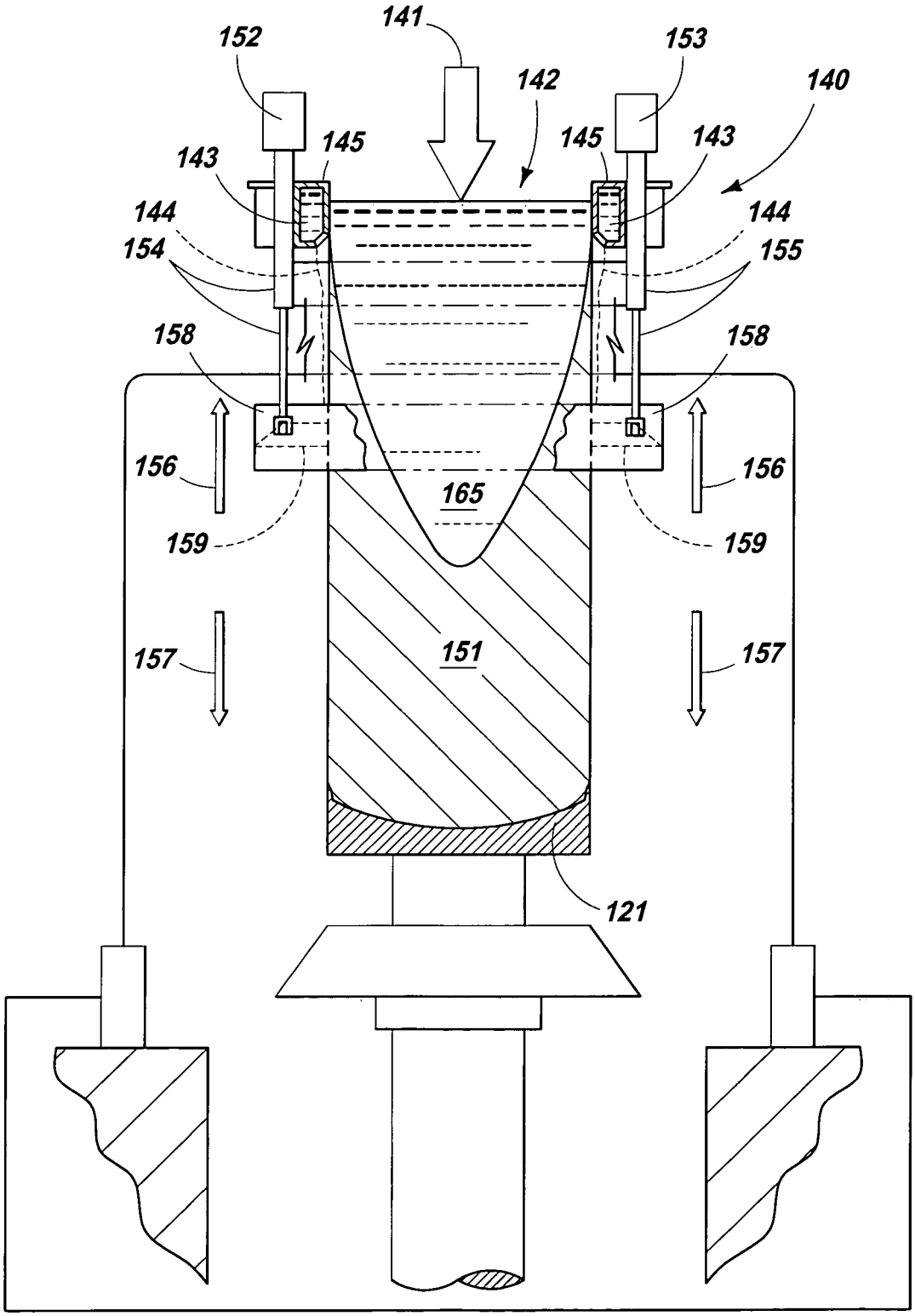
FIG. 6 is an elevation cross-section view of one example of a casting configuration that may be used to practice embodiments of this invention, illustrating the coolant control or wiper system in a position above the lower level of the molten metal in the castpart.

FIG. 6 is an elevation cross-section view of one example of a casting configuration that may be used to practice embodiments of this invention, illustrating the coolant control or wiper system 140 wherein the castpart wiper 158 is positioned above the lower level of the still molten metal 165 in the center of the solidifying castpart 151 and in a position after the transient heat-up portion of casting. FIG. 6 illustrates arrow 141 depicting the flow of molten metal 142 into the mold cavity, mold framework 145 with water conduit 143 therein, coolant 144 applied to the solidifying castpart 151, hydraulic ram actuators 152 and 153, hydraulic ram 154 and 155 for moving the wiper framework 158 with wiper 159 mounted thereto. Arrows 156 and 157 illustrate the potential movement of the wiper framework 158 relative to the castpart and the starting block 121 is shown under castpart 151. When the castpart wiper is moved away from the mold cavity during a second transitory stage of the casting, it may be moved away from the casting mold at a rate determined to result in a sufficient ingot temperature to relieve solidification stress while maximizing ingot strength at temperature. The wiper generally stops at a final position below the mold which maintains this balance through steady state.

Figure 7:
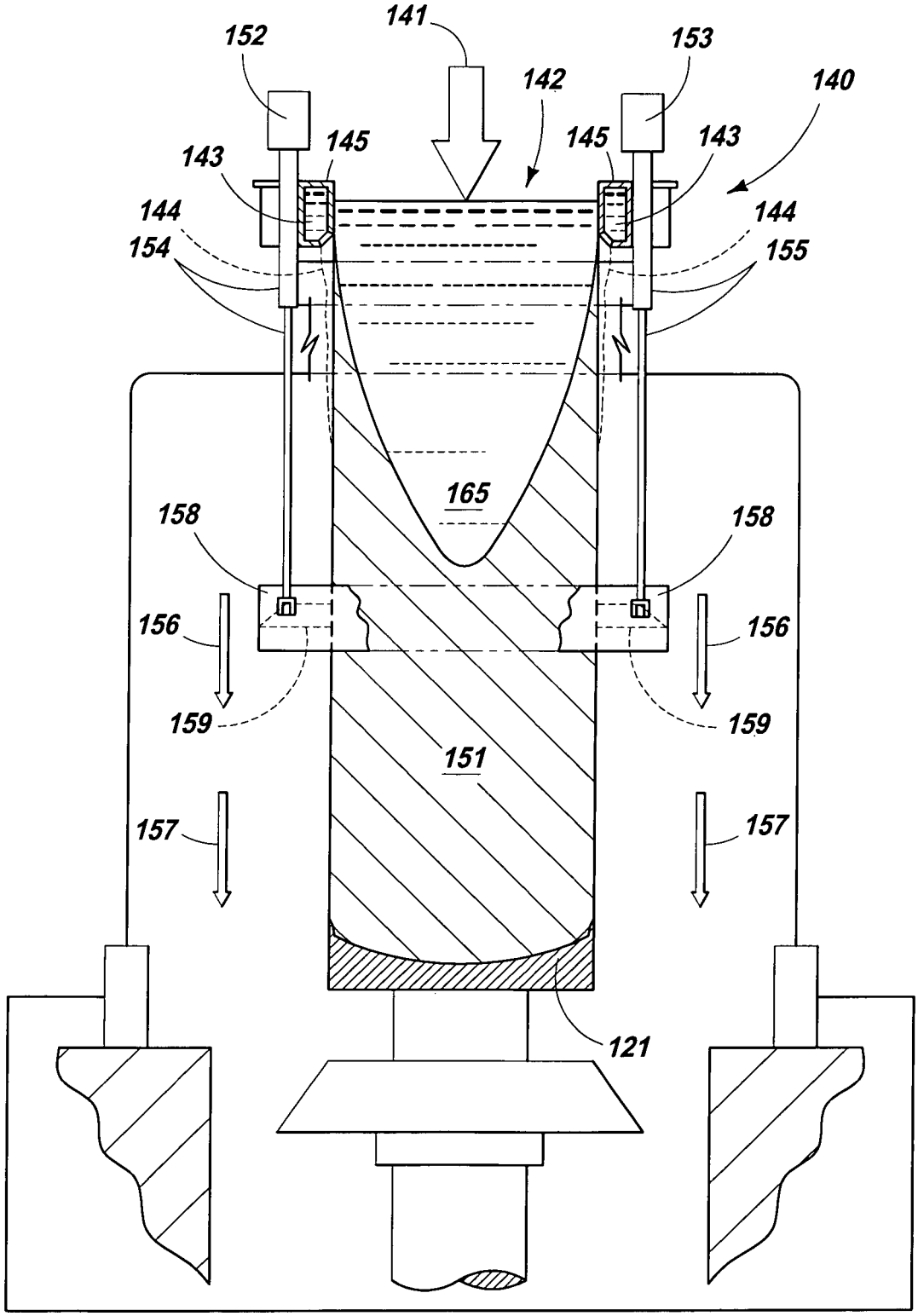
FIG. 7 is an elevation cross-section view of one example of a casting configuration that may be used to practice embodiments of this invention, illustrating the coolant control or wiper system in a position below the lower level of the molten metal in the castpart.

FIG. 7 is an elevation cross-section view of one example of a casting configuration that may be used to practice embodiments of this invention, illustrating the coolant control or wiper system 140 in a position below the molten metal core 165 in the castpart 151. Like numbered items from FIG. 6 will not be repeated here. FIG. 7 illustrates that the wiper framework 159 and wiper 158 are located below the level of the core molten metal 165. The wiper framework 159 may be controlled to be stationary, to be moving downwardly at less than or about the same rate that the bottom block 121 is being lowered during casting, and/or greater than the rate that the bottom block 121 is being lowered—depending on the application and the desired cooling effects.

Figure 8:
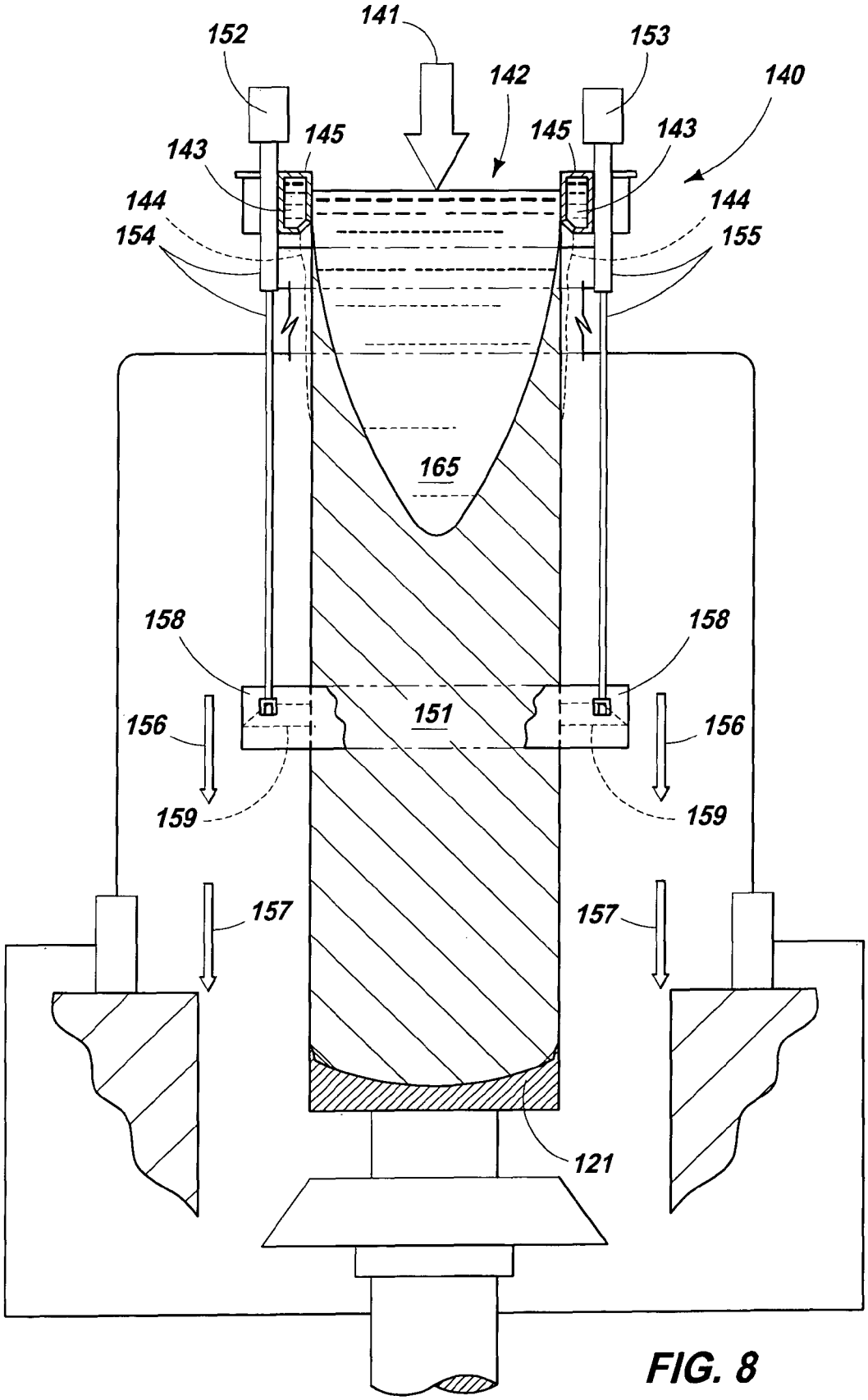
FIG. 8 is an elevation cross-section view of one example of a casting configuration that may be used to practice embodiments of this invention, illustrating the coolant control or wiper system in a position still further below the lower level of the molten metal in the castpart.

FIG. 8 is an elevation cross-section view of one example of a casting configuration that may be used to practice embodiments of this invention, illustrating the coolant control or wiper system in a position even further below the molten metal core 165 in the castpart 151 than shown in FIG. 7. Like numbered items from FIGS. 6 and 7 will not be repeated here. FIG. 8 illustrates that the wiper framework 159 and wiper 158 are located still further below the level of the core molten metal 165, below the sump.

FIG. 9 is a table illustrating exemplary positions of the wiper motion versus the sump depth for some embodiments of the invention.

Figure 10:
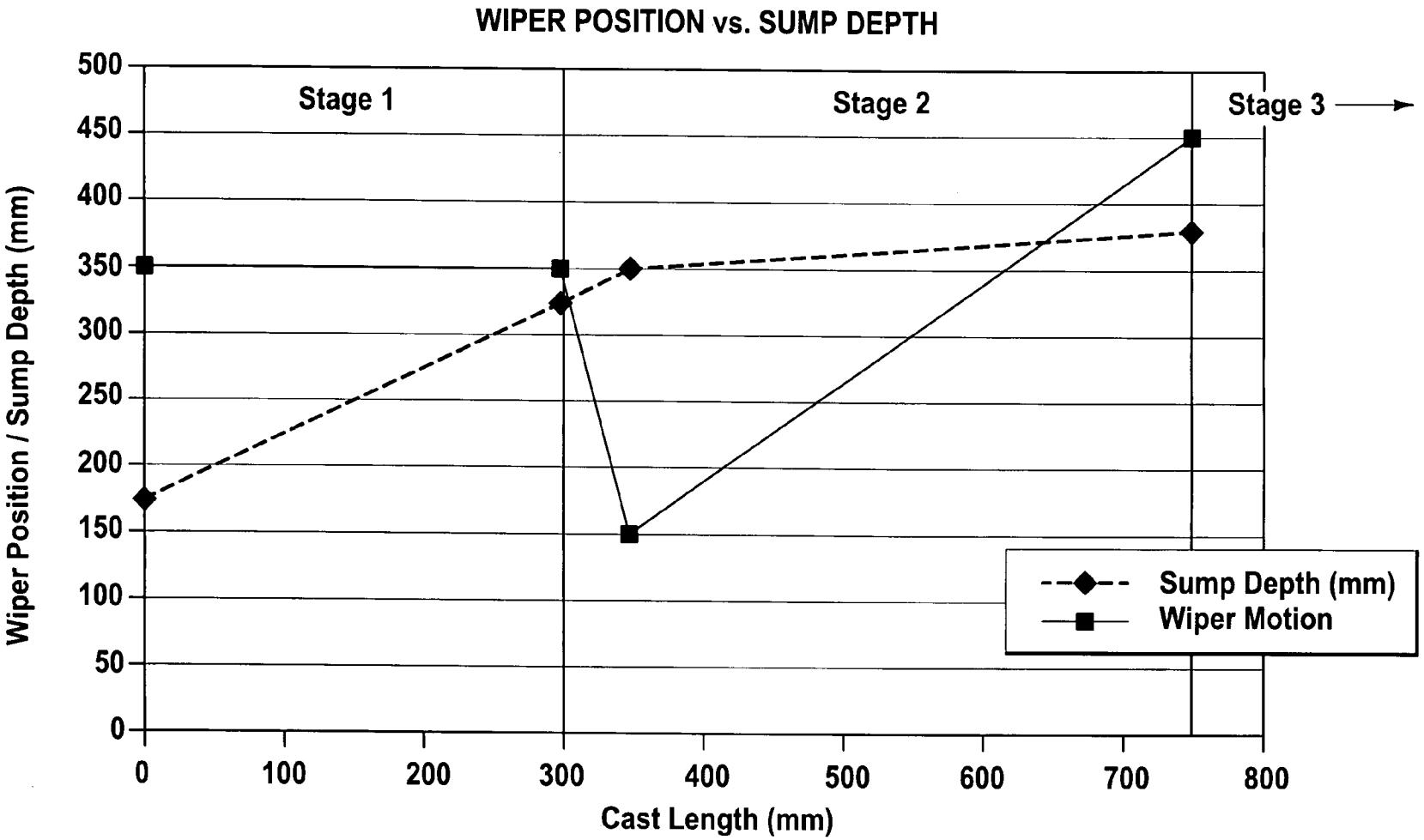
FIG. 10 is a graph illustrating exemplary positions of the wiper position versus the sump depth for some embodiments of this invention.

FIG. 10 is a graph illustrating exemplary positions of the wiper position versus the sump depth for some embodiments of this invention.

As will be appreciated by those of reasonable skill in the art, there are numerous embodiments to this invention, and variations of elements and components which may be used, all within the scope of this invention.

In one embodiment for example, a continuous casting mold coolant wiper control system is provided which includes a continuous casting mold with a mold cavity configured to produce a castpart; a castpart wiper support structure mounted relative to the mold cavity; a castpart wiper configured to conform around an outer surface of the castpart to control the flow of coolant away from the outer surface of the castpart, the castpart wiper being movably mounted to the wiper support structure for movement between positions relative to the mold cavity, such that a startup position is provided sufficiently below the casting mold and castpart starting block to avoid mis-directing coolant during a startup phase of the casting, a transition heat-up position is provided immediately at or below the mold cavity, and a moving second transitory stage position is provided such that the wiper is moved away from the casting mold at a rate determined to result in a predetermined castpart solidification effect.

In further embodiments of that described in the preceding paragraph, a continuous casting mold coolant system as recited in the preceding paragraph and further wherein three separate configurations are provided, namely: the first wherein during the moving second transitory stage position is away from the mold cavity at a rate approximately equal to movement of the castpart; the second wherein during the moving second transitory stage position is away from the mold cavity at a rate less than a rate of movement of the castpart; and the third is wherein during the moving second transitory stage position is away from the mold cavity at a rate greater than a rate of movement of the castpart.

It will also be appreciated that there are process embodiments of this invention, such as a continuous casting mold coolant wiper control process comprising the following: providing a continuous casting mold with a mold cavity configured to cast a castpart; providing a castpart wiper configured to conform around an outer surface of the castpart and thereby direct the flow of coolant away from the outer surface of the castpart; positioning the castpart wiper sufficiently below the casting mold and castpart starting block to avoid mis-directing coolant during a startup phase of the casting; initiating the casting and providing coolant to the casting mold; rapidly moving the castpart wiper to a position immediately at or below the mold cavity during a transition heat-up phase of the casting; and moving the castpart wiper away from the mold cavity during a second transitory stage of the casting at a rate determined to result in a predetermined castpart solidification effect.

In further embodiments of that described in the preceding paragraph, a continuous casting mold coolant wiper control process as recited in the preceding paragraph and further wherein three separate configurations are provided, namely: the first wherein during the second transitory stage of the casting, the castpart wiper is moved away from the casting mold at a rate approximately equal to movement of the castpart; the second wherein during the second transitory stage of the casting, the castpart wiper is moved away from the casting mold at a rate less than the movement of the castpart; and the third wherein during the second transitory stage of the casting, the castpart wiper is moved away from the casting mold at a rate greater than the movement of the castpart.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A continuous casting mold coolant wiper control process comprising the following:

providing a continuous casting mold with a mold cavity configured to cast a castpart;

providing a castpart wiper configured to conform around an outer surface of the castpart and thereby direct flow of coolant away from the outer surface of the castpart;

positioning the castpart wiper at an initial startup position sufficiently below the castpart starting block to avoid mis-directing coolant during a startup phase of casting;

initiating casting and providing coolant to the casting mold;

rapidly moving the castpart wiper from the initial startup position to a position immediately at or near the mold cavity and above the position at which a core of the castpart becomes solid during a transition heat-up phase of casting; and then moving the castpart wiper away from the mold cavity during a second transitory stage of the casting at a rate determined to result in a predetermined castpart solidification effect and below a position at which the core of the castpart becomes solid.

2. A continuous casting mold coolant wiper control process as recited in claim 1, and further wherein during the second transitory stage of the casting, the castpart wiper is moved away from the casting mold at a rate approximately equal to movement of the castpart.

3. A continuous casting mold coolant wiper control process as recited in claim 1, and further wherein during the second transitory stage of the casting, the castpart wiper is moved away from the casting mold at a rate less than the movement of the castpart.

4. A continuous casting mold coolant wiper control process as recited in claim 1, and further wherein during the second transitory stage of the casting, the castpart wiper is moved away from the casting mold at a rate greater than the movement of the castpart.

5. A continuous casting mold coolant wiper control process as recited in claim 1, and further wherein when moving the castpart wiper away from the mold cavity during the second transitory stage of the casting it is moved to below a position at which the core of the castpart becomes solid.

6. A continuous casting mold coolant wiper control process comprising the following:

providing a continuous casting mold with a mold cavity configured to cast a castpart;

providing a castpart wiper configured to conform around an outer surface of the castpart and thereby direct flow of coolant away from the outer surface of the castpart;

positioning the castpart wiper at an initial startup position sufficiently below the castpart starting block to avoid mis-directing coolant during a startup phase of casting;

initiating casting and providing coolant to the casting mold;

rapidly moving the castpart wiper from the initial startup position to a position immediately at or near the mold cavity and above the position at which the core of the castpart becomes solid during a transition heat-up phase of casting; and then moving the castpart wiper away from the mold cavity during a second transitory stage of casting at a rate determined to result in a predetermined castpart solidification effect and below a position at the core of the castpart is between molten and solidified.

* * * * *